US012520869B2

(12) United States Patent
Sherrett

(10) Patent No.: US 12,520,869 B2
(45) Date of Patent: Jan. 13, 2026

(54) WATER PIPE ADAPTER

(71) Applicant: Daniel Vincent Sherrett, Upper Marlboro, MD (US)

(72) Inventor: Daniel Vincent Sherrett, Upper Marlboro, MD (US)

( * ) Notice: Subject to any disclaimer, the term of this patent is extended or adjusted under 35 U.S.C. 154(b) by 732 days.

(21) Appl. No.: 17/579,080

(22) Filed: Jan. 19, 2022

(65) Prior Publication Data

US 2023/0225394 A1 Jul. 20, 2023

(51) Int. Cl.

| | |
|---|---|
| ***A24F 1/30*** | (2006.01) |
| ***A24F 1/28*** | (2006.01) |
| ***A24F 5/02*** | (2006.01) |

(52) U.S. Cl.

CPC ..... *A24F 1/30* (2013.01); *A24F 1/28* (2013.01); *A24F 5/02* (2013.01)

(58) Field of Classification Search

None

See application file for complete search history.

(56) References Cited

U.S. PATENT DOCUMENTS

| | | | | |
|---|---|---|---|---|
| 6,067,993 | A * | 5/2000 | Mahoney, III | A24F 1/30 131/212.2 |
| 9,930,911 | B1 * | 4/2018 | Wright | A24F 1/30 |
| 2020/0120976 | A1 * | 4/2020 | Liu | A24F 1/30 |
| 2020/0367552 | A1 * | 11/2020 | Delgado | A24F 1/30 |

FOREIGN PATENT DOCUMENTS

| | | | | |
|---|---|---|---|---|
| WO | WO-2019106593 | A1 * | 6/2019 | A24F 1/30 |

* cited by examiner

*Primary Examiner* — Michael H. Wilson
*Assistant Examiner* — Ronnie Kirby Jordan
(74) *Attorney, Agent, or Firm* — LAUBSCHER & FRETWELL, P.C.

(57) ABSTRACT

A water pipe bowl adapter includes a body having an upper end surface, a lower end surface, an outer edge, and a flexible lip that extends downwardly from the body outer edge. There is a through opening extending through each of the upper and lower end surfaces. The lip and lower end recessed portion form a seal for connection with an upper end of a water pipe bowl. When the adapter is arranged on a water pipe bowl, the lip covers an outer surface of an upper portion of the bowl and is secured therewith via a frictional force and the lower end contacts an upper edge of the bowl to connect the adapter with the bowl and create an airtight seal therewith. A user can then place a cigarette in the through opening and smoke through a water pipe with an airtight, secure seal.

10 Claims, 6 Drawing Sheets

WATER PIPE ADAPTER

BACKGROUND OF THE DISCLOSURE

The present disclosure relates generally to water pipes, and more specifically to an adapter for water pipe bowls.

Water pipes are well known in the smoking apparatus field. A typical pipe includes a base, a removable bowl, a smoking chamber and a mouthpiece, among other elements. When the bowl, having cannabis, tobacco or another substance placed therein, is connected to the pipe and a substance is lit, a user inhales through the mouthpiece, and smoke travels through the chamber to the user. Water is often placed within the pipe to filter the smoke before it is inhaled.

A "joint bubbler", as shown in prior art FIGS. 1 and 2, is similar to a water pipe but on a smaller scale and for a different purpose. This apparatus includes a bulbous body containing two openings, one having a tubular configuration through which a user inhales, and the other having a generally conical configuration for receiving a cigarette (shown in FIG. 2). In practice, a user adds water to the bulbous portion through one of the two openings, inserts a marijuana or tobacco cigarette into the conical opening, lights the cigarette, and inhales through the tubular opening. As with the water pipe, the water filters the smoke as it passes through the bulbous portion.

Though these joint bubblers are useful and can be a good substitute to a water pipe when smoking a cigarette, they require a separate apparatus from the water pipe, they are expensive, they break easily, and they are complex for glass makers to construct. Rather than rely on these devices when one wishes to smoke a cigarette through a water pipe, a new apparatus is needed that is less expensive, simpler, and more durable.

SUMMARY OF THE DISCLOSURE

Accordingly, it is an object of the present disclosure to provide a water pipe bowl adapter that includes a body having an upper end surface, a lower end surface, an outer edge, and a flexible lip that extends downwardly from the body outer edge to create a lower end recessed portion. The lip and lower end recessed portion form a seal for connection with an upper end of a water pipe bowl. A through opening in the body extends through each of the upper and lower end surfaces, with which a cigarette can connect. When the adapter is connected with a water pipe bowl, the lip covers an outer surface of an upper portion of the bowl and is secured therewith via a frictional force, and the lower end contacts an upper edge of the bowl to connect the adapter with the bowl and create an airtight seal therewith. A user can then place a cigarette in the through opening and smoke through a water pipe with an airtight, secure seal. Preferably, the body has a cylindrical configuration and comprises silicone material.

In one embodiment, there is a tubular insert configured for an airtight connection with the body through opening. The insert includes an upper end having a flange connected therewith and a lower end. The tubular insert further contains a through opening extending through each of the upper end and lower end. When inserted into the adapter opening, the flange prevents the insert from passing through the adapter opening. A cigarette can then be placed in the insert for ease of smoking.

In another embodiment of the adapter, the body lower end surface further includes a convex portion extending therefrom which contains the body through opening and is configured for connection with an inner surface of a water pipe bowl. For this embodiment, the edge of the flexible lip extends inwardly toward a center point of the body, and a distance between the convex portion and the outer edge corresponds with a width between an inner surface and an outer surface of the water pipe bowl.

In a further embodiment, the body comprises an elastic material wherein the flexible lip is removably connectable with a water pipe bowl via a stretch force. Preferably, the body has a generally annular configuration.

In yet another embodiment, the body through opening is located at a center of the body and has a circular configuration in a horizontal cross-section.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1:
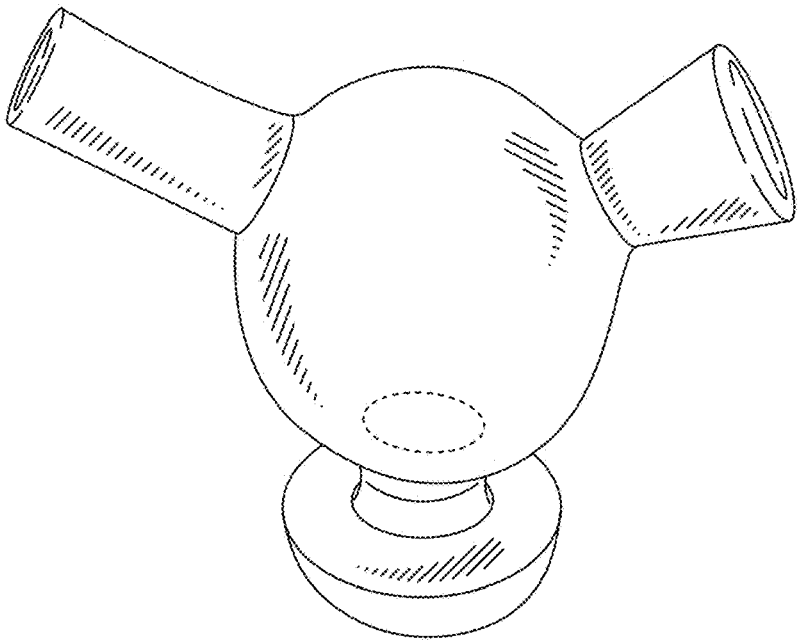
FIG. 1 PRIOR ART
FIG. 1 is a front perspective view of a water pipe adapter known in the art.
Figure 2:
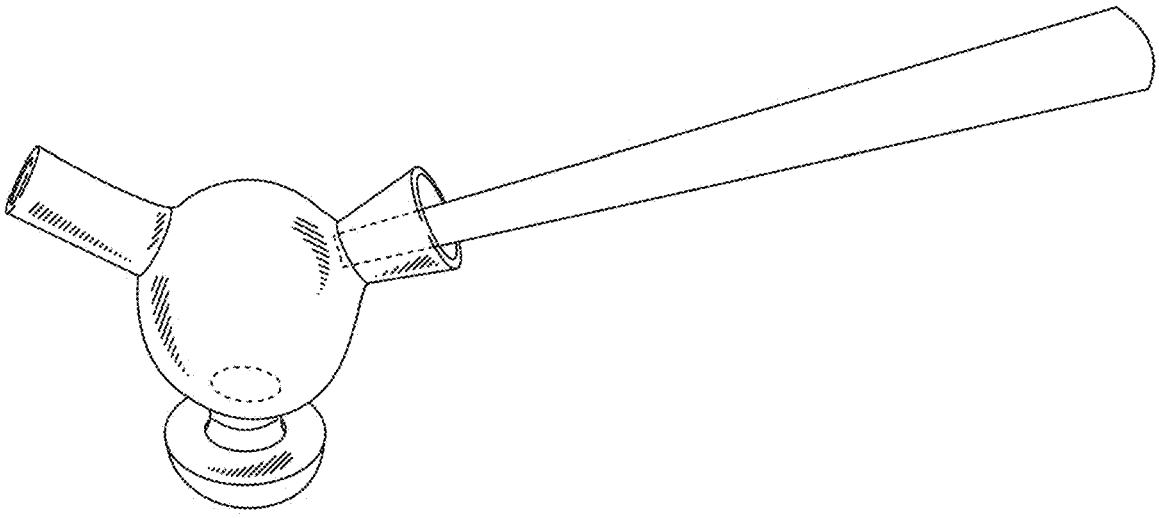
FIG. 2 PRIOR ART
FIG. 2 is a front perspective view of the adapter of FIG. 1 with a cigarette therein.
Figure 3:
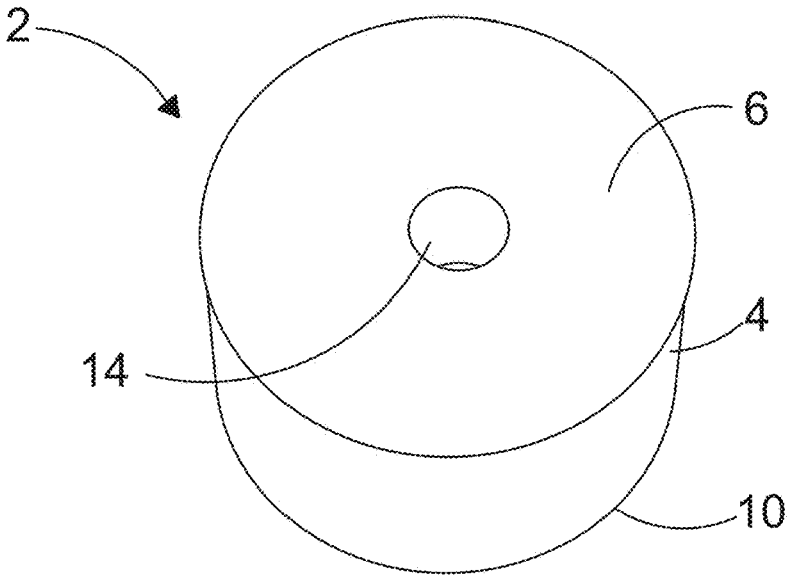
FIG. 3 is top perspective view of a first embodiment of water pipe adapter according to the present disclosure.
Figure 4:
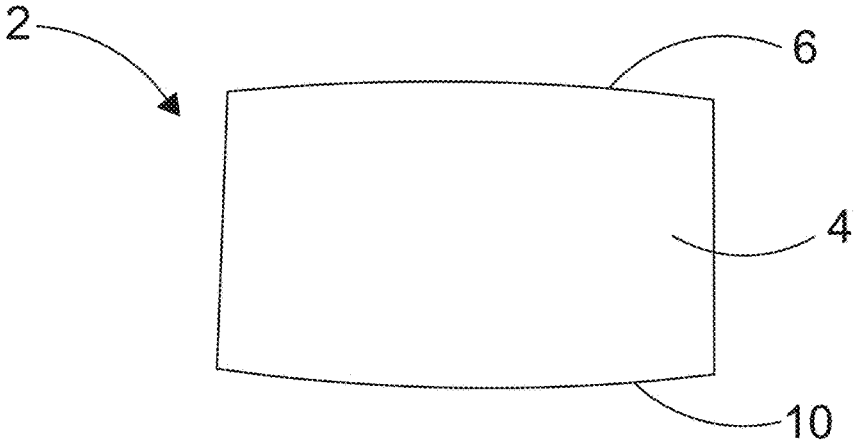
FIG. 4 is a side view of the adapter of FIG. 3.
Figure 5:
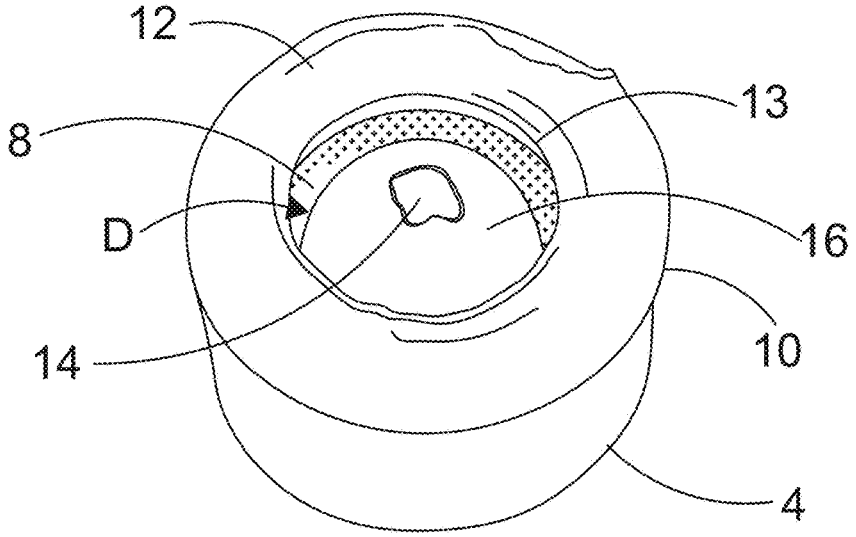
FIG. 5 is a bottom perspective view of the adapter of FIG. 3.

The present disclosure includes a water pipe bowl adapter. Referring first to FIGS. 3-5, the adapter 2 includes a body 4 having an upper end surface 6, a lower end surface 8, an outer edge 10, and a flexible lip 12 that extends downwardly from the body outer edge. There is a through opening 14 extending through each of the upper and lower end surfaces. The lip and lower end recessed portion form a seal for connection with an upper end of a water pipe bowl (see FIGS. 8-10). Once connected with the bowl, the bowl is placed in a down stem of a water pipe, a cigarette is placed in the adapter, and a user can then light the cigarette and inhale smoke through a mouthpiece in the water pipe.

The body 4 of this embodiment has a cylindrical configuration and is comprised of silicone material. As shown in FIG. 5, the body lower end surface 8 further includes a convex portion 16 extending therefrom which contains the through opening and has a hemispherical configuration. This is configured for connection with an inner surface of a water pipe bowl. A distance D between the convex portion and the edge 13 of the lip 12 corresponds with a width between an inner surface and an outer surface of the water pipe bowl. It will be understood by those with skill in the art that this distance D may vary based on the size of a corresponding bowl.

Figure 8:
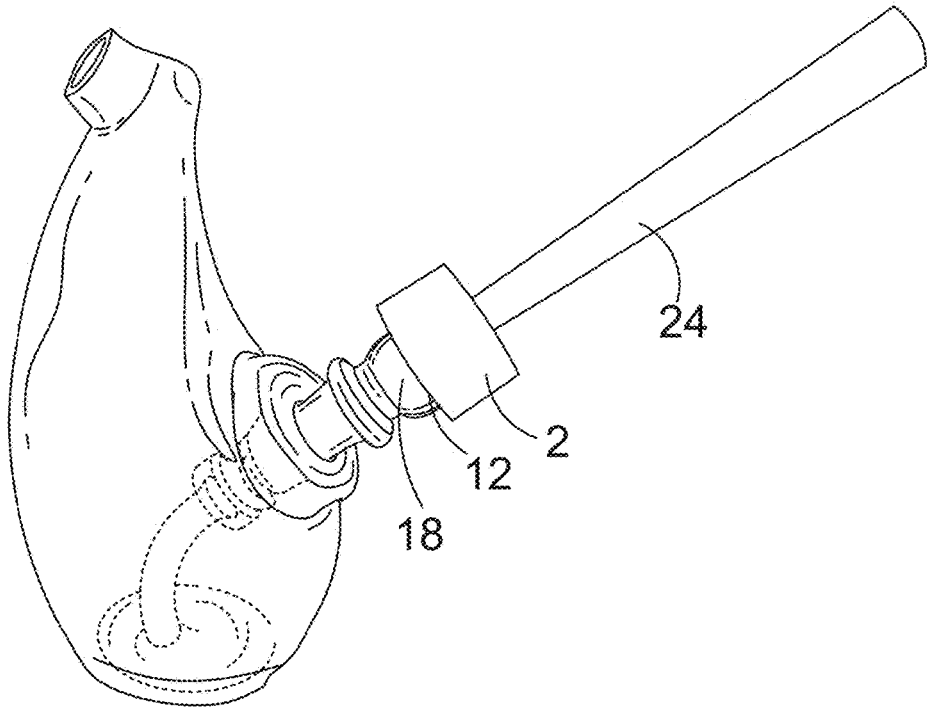
FIGS. 8 and 9 are perspective views of a water pipe bowl with the adapter of FIG. 3 connected therewith.
Figure 9:
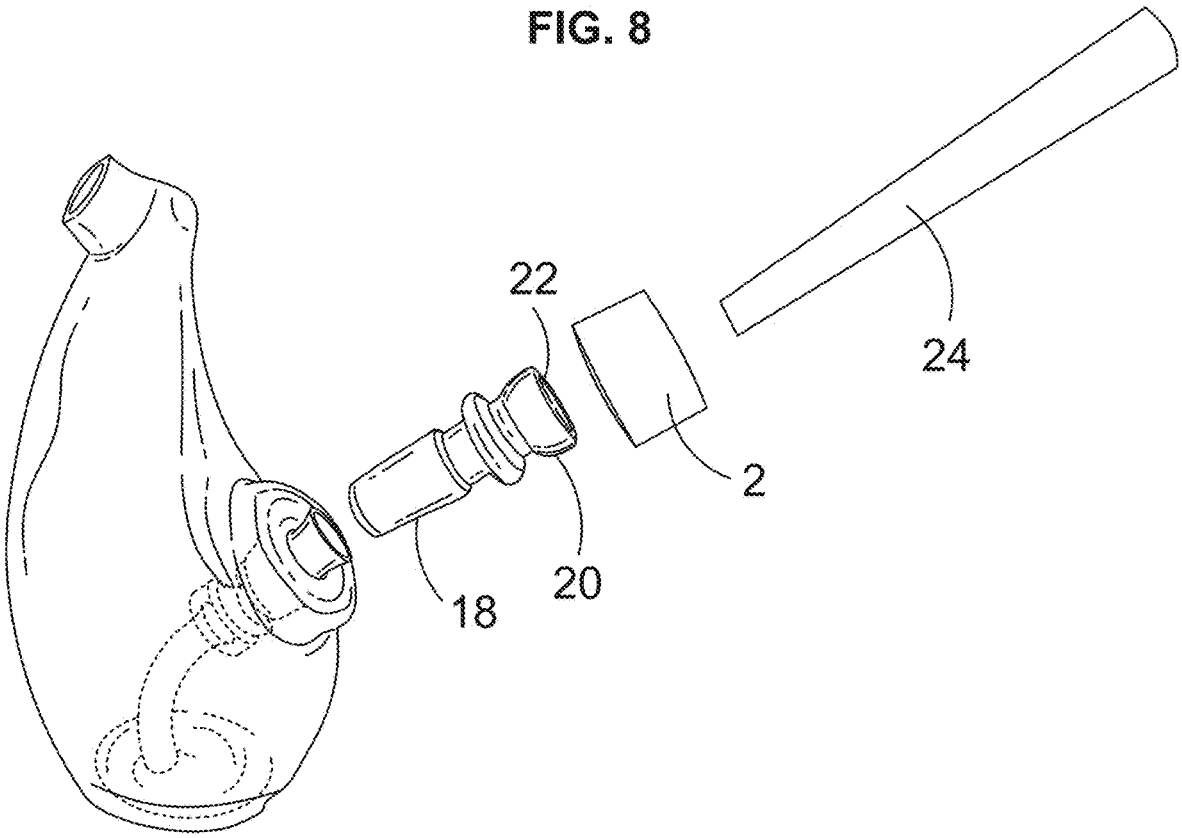

As shown in FIGS. 8 and 9, when the adapter 2 is arranged on a water pipe bowl 18, the lip 12 covers an outer surface of an upper portion 20 of the bowl and is secured therewith via a frictional force provided due to the flexibility of the adapter material. The lower end 8 of the body contacts an upper edge 22 of the bowl to connect the adapter with the bowl and create an airtight seal therewith. Once connected, a cigarette 24 is inserted into the adapter and smoked as detailed above.

Figure 6:
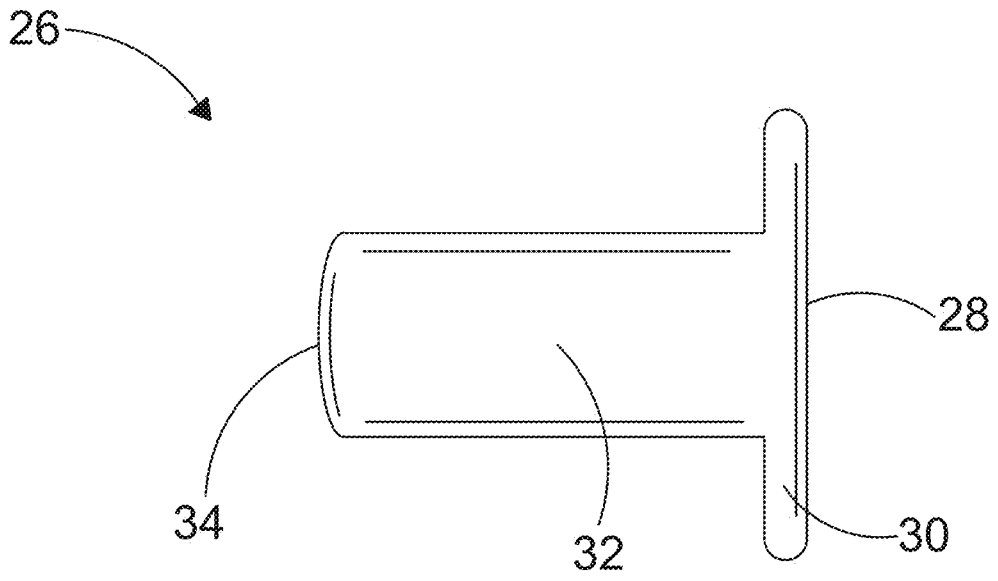
FIG. 6 is a side view of a water pipe adapter insert according to the present disclosure.
Figure 7:
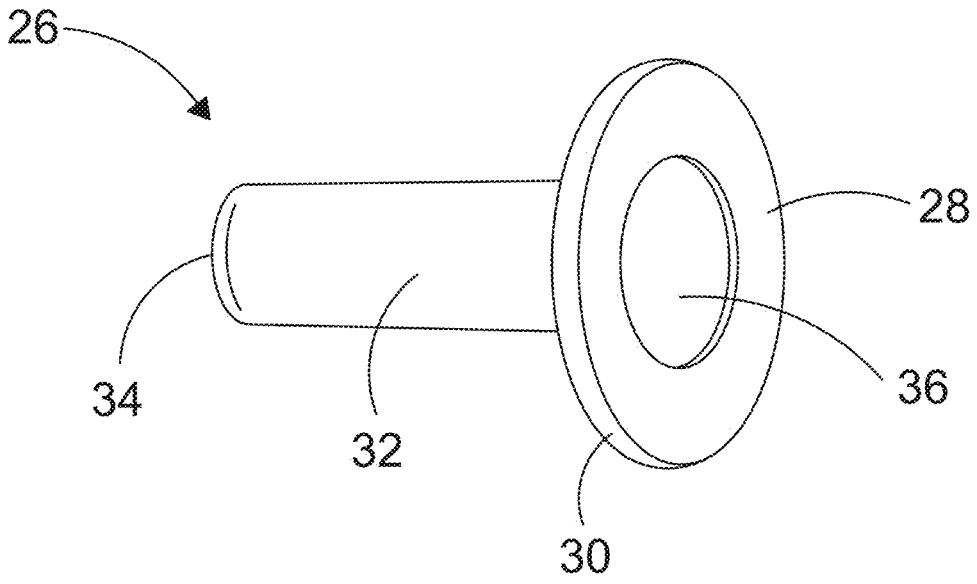
FIG. 7 is a perspective view of the insert of FIG. 6.
Figure 10:
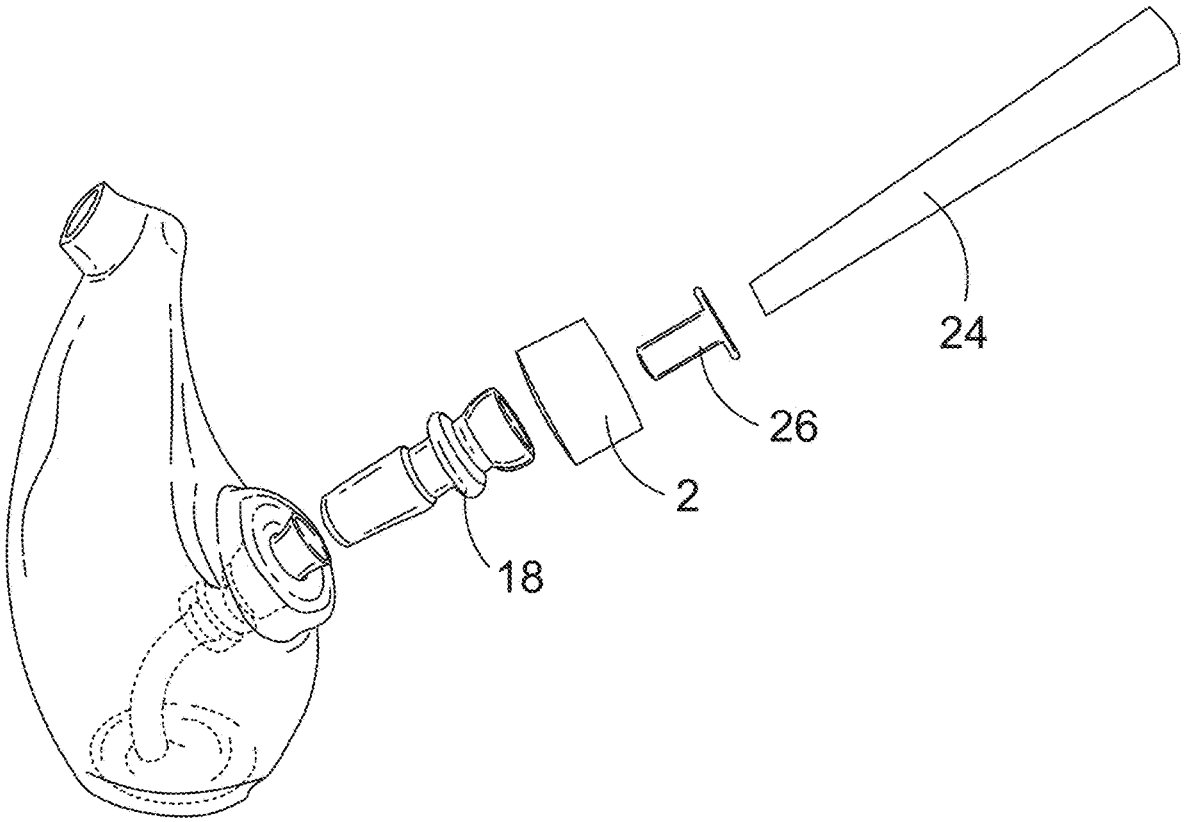
FIG. 10 is a perspective view of the water pipe bowl with adapter of FIGS. 8 and 9 with the insert included.

Referring now to FIGS. 6 and 7, the adapter further includes a tubular insert 26 configured for an airtight connection with the body through opening 14. The insert includes an upper end 28 having a flange 30, a central body 32 and a lower end 34. The tubular insert contains a through opening 36 extending through each of the upper end and lower end. This adapter may be included to provide a more secure connection between a cigarette and the adapter to secure a cigarette therewith. FIG. 10 shows the water pipe bowl of FIGS. 8 and 9 with the insert included between adapter 2 and cigarette 24.

Figure 11:
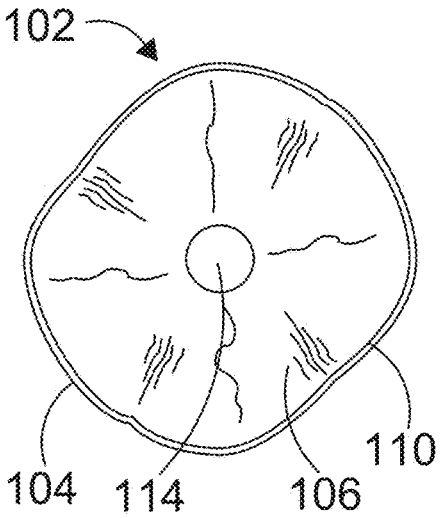
FIG. 11 is a top view second embodiment of a water pipe bowl adapter according to the present disclosure.
Figure 12:
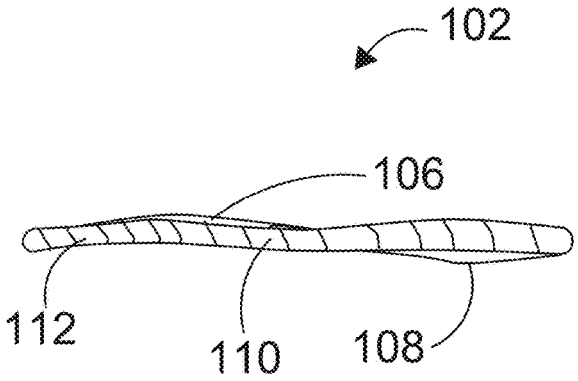
FIG. 12 is a side view of the adapter of FIG. 11.

FIGS. 11 and 12 show another embodiment of the adapter 102. Similarly, this embodiment includes a body 104, an upper end surface 106, a lower end surface 108, an outer edge 110, a flexible lip 112, and a central through opening 114. Unlike with the embodiment of FIGS. 3-5, the body has a flat, disc-like configuration. The body also comprises an elastic material, such as latex or a similar synthetic material, wherein the body is configured to stretch such that the flexible lip is pulled over the upper end of a bowl to removably connect the adapter with the bowl upper edge 22 (FIGS. 9 and 10). The elasticity of the adapter and lip secure the adapter on the bowl upper edge.

Figure 13:
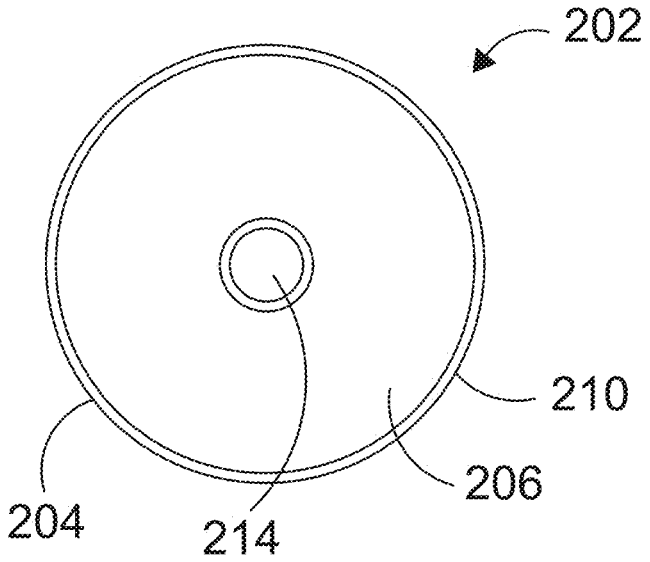
FIG. 13 is a top view of a third embodiment of a water pipe bowl adapter according to the present disclosure.
Figure 14:
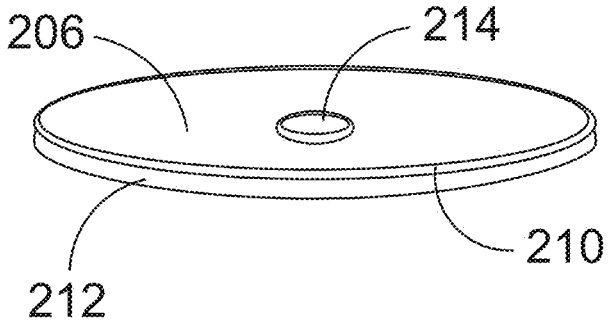
FIG. 14 is a top perspective view of the adapter of FIG. 13.
Figure 15:
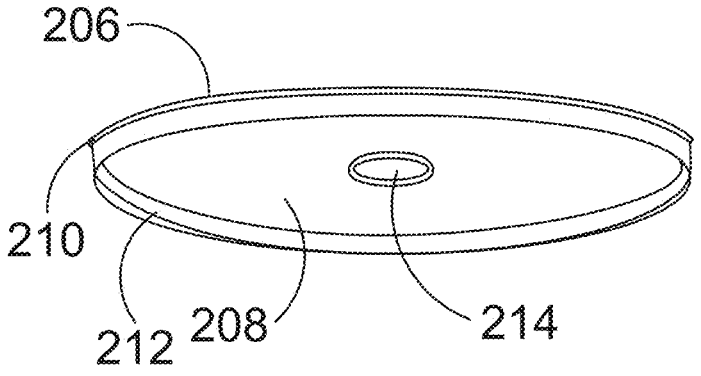
FIG. 15 is a bottom perspective view of the adapter of FIG. 13.

FIGS. 13-15 show a third embodiment of the adapter 202. In this embodiment, the body 204 also includes an upper end surface 206, a lower end surface 208, an outer edge 210, and a flexible lip 212. This embodiment comprises a more rigid material, though with sufficient flexure to allow for connection with a water pipe bowl that does not directly correspond to the configuration of the adapter. There is also a through opening 214 located at a center of the body with which a cigarette can be inserted. For this embodiment, the adapter is placed over a bowl such that the lower end surface 208 contacts the upper edge of the bowl. The lip 212 extends downwardly to secure the adapter to the bowl and prevent unwanted air from entering the bowl. Preferably, the lip has a width that generally corresponds to the width of the upper end of a bowl.

Although the above description references particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. An adapter for a removable water pipe bowl configured for connection with a down stem of a water pipe, comprising:

(a) a body having an upper end surface, a lower end surface including a hemispherical portion, and a sidewall extending from an outer edge of the upper end surface and terminating at a sidewall lower end edge, said lower end surface hemispherical portion and sidewall defining a recessed portion therebetween, said body containing a through opening extending through each said upper and lower end surfaces; and (b) a flexible lip extending inwardly from said sidewall lower end edge toward a center of the body and terminating at a lip edge, said lip, recessed portion, and lower end hemispherical portion forming a seal for connection with an upper end of a water pipe bowl, whereby when the adapter is arranged on a water pipe bowl, said lip covers an outer surface of an upper portion of the bowl and is secured therewith via a frictional force and said lower end surface contacts an upper edge and an inner surface of the bowl to connect the adapter with the bowl and create an airtight seal therewith.

2. The adapter defined in claim 1, and further comprising a tubular insert configured for an airtight connection with said body through opening, said insert including an upper end and a lower end, said upper end having a flange, said tubular insert containing a through opening extending through each said upper end and lower end.

3. The adapter defined in claim 1, wherein a distance between said convex portion and said outer edge corresponds with a width between said inner surface and an outer surface of the water pipe bowl.

4. The adapter defined in claim 1, wherein said body has a cylindrical configuration.

5. The adapter defined in claim 4, wherein said body comprises a silicone material.

6. The adapter defined in claim 1, wherein said body comprises an elastic material, said flexible lip being removably connectable with a water pipe bowl via a stretch force.

7. The adapter defined in claim 6, wherein said body has a generally annular configuration.

8. The adapter defined in claim 1, wherein said body through opening is located at a center of said body, said body through opening having a circular configuration in a horizontal cross-section.

9. A connection apparatus configured for connection with a down stem of a water pipe, comprising:

(a) a bowl including a rounded upper end for receiving a substance and a lower end for connection with a down stem of a water pipe bowl, a through opening extending through a center of the bowl from said rounded upper end through said lower end;

(b) an adapter removably connected with the bowl, the adapter including a body upper end surface, lower end surface, outer edge, sidewall extending downwardly from said outer edge to define a lower end recessed portion, and a through opening extending through each said upper and lower end surfaces of said body to align with said bowl through opening, said lip and lower end recessed portion forming a seal for connection with said bowl rounded upper end, whereby when said adapter is arranged on a water pipe bowl, said lip covers an outer surface of an upper portion of the bowl and is secured therewith via a frictional force and said lower end contacts an upper edge of the bowl to connect the adapter with the bowl and create an airtight seal therewith.

10. The apparatus of claim 9, wherein the body lower end surface includes a hemispherical portion and the body further includes a flexible lip extending inwardly from said body sidewall toward a center of the body, said recessed portion being arranged between said sidewall and said lower end surface hemispherical portion.

* * * * *